US005564612A

United States Patent [19]

Gregory

[11] Patent Number: 5,564,612

[45] Date of Patent: Oct. 15, 1996

[54] MODULAR BACKPACK

[75] Inventor: Wayne B. Gregory, Temecula, Calif.

[73] Assignee: Bianchi International, Temecula, Calif.

[21] Appl. No.: 379,992

[22] Filed: Jan. 27, 1995

[51] Int. Cl.[6] ..... A45F 3/08

[52] U.S. Cl. ..... 224/633; 224/637; 224/635

[58] Field of Search ..... 224/210–213, 224/261–263, 628, 633, 635, 636, 637

[56] References Cited

U.S. PATENT DOCUMENTS

| | | | |
|---|---|---|---|
| 3,733,017 | 5/1973 | Pletz | 224/211 |
| 4,018,370 | 4/1977 | Wood | 224/263 |
| 4,135,654 | 1/1979 | Chu | 224/261 |
| 4,676,418 | 6/1987 | Lowe | 224/215 |
| 5,228,609 | 6/1987 | Gregory | 224/209 |
| 5,240,159 | 7/1993 | Gregory | 224/224 |
| 5,284,280 | 2/1994 | Stonebraker, Sr. et al. | 224/210 X |

FOREIGN PATENT DOCUMENTS

| | | | |
|---|---|---|---|
| 2754061 | 6/1979 | Germany . | |
| 3829145 | 8/1988 | Germany . | |
| 2178646 | 2/1987 | United Kingdom | 224/213 |
| 2275965 | 9/1994 | United Kingdom | 224/211 |
| WO91/05493 | 5/1991 | WIPO . | |

OTHER PUBLICATIONS

1993 Gregory Mountain Products Catalog, pp. 4 and 5.

*Primary Examiner*—Renee S. Luebke
*Attorney, Agent, or Firm*—Wagner & Middlebrook

[57] ABSTRACT

A backpack includes a pair of contoured side rails and three separate molded plastic support members removably attached to the rails. The upper support member includes a structure for carrying much of the weight of the carry bag. The carry bag includes hook and loop fasteners on fabric strips for securing the bag to the rails. The upper support member and other support members include slots and ports for attaching various straps and pads. One of the support members includes a flexible section to which the waistband and pad structure is attached, thereby providing flexibility to accommodate hip movement of the wearer. Separate back and lumbar pads are strapped to the support members. The separate plastic support members may be removed from one pair of contoured side rails and fastened to a pair of side rails of different length to accommodate wearers of different heights and proportions.

20 Claims, 5 Drawing Sheets

MODULAR BACKPACK

BACKGROUND OF THE INVENTION

This invention relates to backpacks and particularly to backpack structures suitable for carrying substantial loads for extended time periods. Much has been done in the design of backpacks to deal with discomfort on the part of the wearer resulting from pressure points at any of a number of locations. Typical areas of such concentrated loads may be on the shoulders or hips or the back itself may become tired if too much a load has been carried on the shoulders for too long, rather than on the hips.

To deal with such problems, manufacturers of backpacks have provided padded shoulder straps, padded waistbands, padded back panels, etc. Typically the back and waistband members have been formed in a single unit. In some cases it has been found that pressure points are actually introduced by the pads themselves since some padded members will tend to wrinkle and bunch up when carried over one's shoulders or around one's waist resulting in creating pressure points.

It has also been found that when the waistband members are combined with the back panels, there is frequently a lack of flexibility which results in the pack not fitting as well as would be desirable. Most of the above problems have been dealt with in a number of ways by a number of different backpack manufacturers and the result has been that such backpacks have become progressively more complex and more expensive. There is thus a need for a truly comfortable backpack for carrying substantial loads which is significantly less expensive than most of the better backpacks presently available.

BRIEF DESCRIPTION OF THE INVENTION

Applicant has, in early models of backpacks, dealt with a number of the potential areas of discomfort by forming padded areas of the backpack with polyfoam pads, some of which are spaced from each other and having a cover of stretch synthetic fabric molded to the pads such that the pads stay in place and do not bunch up, thereby eliminating wrinkling because excess material is dealt with by means of the stretch fabric being molded into the spaces between the pads. Also, by arranging the backpack as a group of modular units, flexibility is enhanced providing superior fit to the wearer.

Many older types of backpacks have used an aluminum frame to which are attached carry bags and various shoulder straps, waist belts, etc. Applicant has provided a backpack using aluminum side rails to which are fastened a number of molded plastic frame members each including fixtures for attaching them to the aluminum side rails. Each of these molded plastic members consists of a significant number of truss structures which are designed with variable wall thicknesses and wall depths to provide strength and stiffness where needed and flexibility where needed. Several padded members and support straps are attached to the molded plastic frame members and the truss structures are designed to provide openings located as required to attach the various pad and strap members and also to be significantly strong at the location of such openings so that the strap members and pads are held securely on the frame members when the backpack is heavily loaded.

The upper frame member is attached to the tops of the aluminum side rails and includes a pair of socket members. Carried in the top of the separate carry bag is a U-shaped aluminum frame which slides into the sockets and thereby carries most of the weight of the carry bag. The upper molded plastic frame member also includes a number of slots for receiving large buckles attached to the shoulder straps which are fed through the slots to secure the shoulder straps to the frame member. This upper frame member also includes an additional pair of fasteners fastening the member to the side rails at a distance below the top of the rails.

Mounted further downwardly on the side rails is a center or second molded plastic frame member. Suspended below the upper part of this member is a relatively flexible "beaver tail" portion. Separate waistband pads are attached to this waist support member which also carries belt and buckle members for fastening the waist band around the waist of the wearer.

The bottom plastic frame member supports a U-shaped support member extending rearwardly where it can be utilized to function as a stand for the backpack and to support a bed roll or other items which the wearer may decide to carry at a location below the carry bag.

A separate backpad member is present. A separate polyfoam lumbar pad is strapped to the center member and also near the bottom of the "beaver tail" portion such that the lumbar pad is also permitted to move somewhat with this flexible portion.

The following features are all present in the improved backpack:

1. The pack may be changed in size for different wearers merely by changing the side rails to rails of different length;
2. The dual mode flexible "beaver tail" portion of the center plastic support member flexibly supports the waist support member; and
3. The design and balance of the frame whereby the bottom plastic frame member acts as a stable platform to rest the pack, when loaded.

BRIEF DESCRIPTION OF THE DRAWINGS

This invention may be more clearly understood with the following detailed description and by reference to the drawings in which.

DETAILED DESCRIPTION OF THE INVENTION

Figure 1:
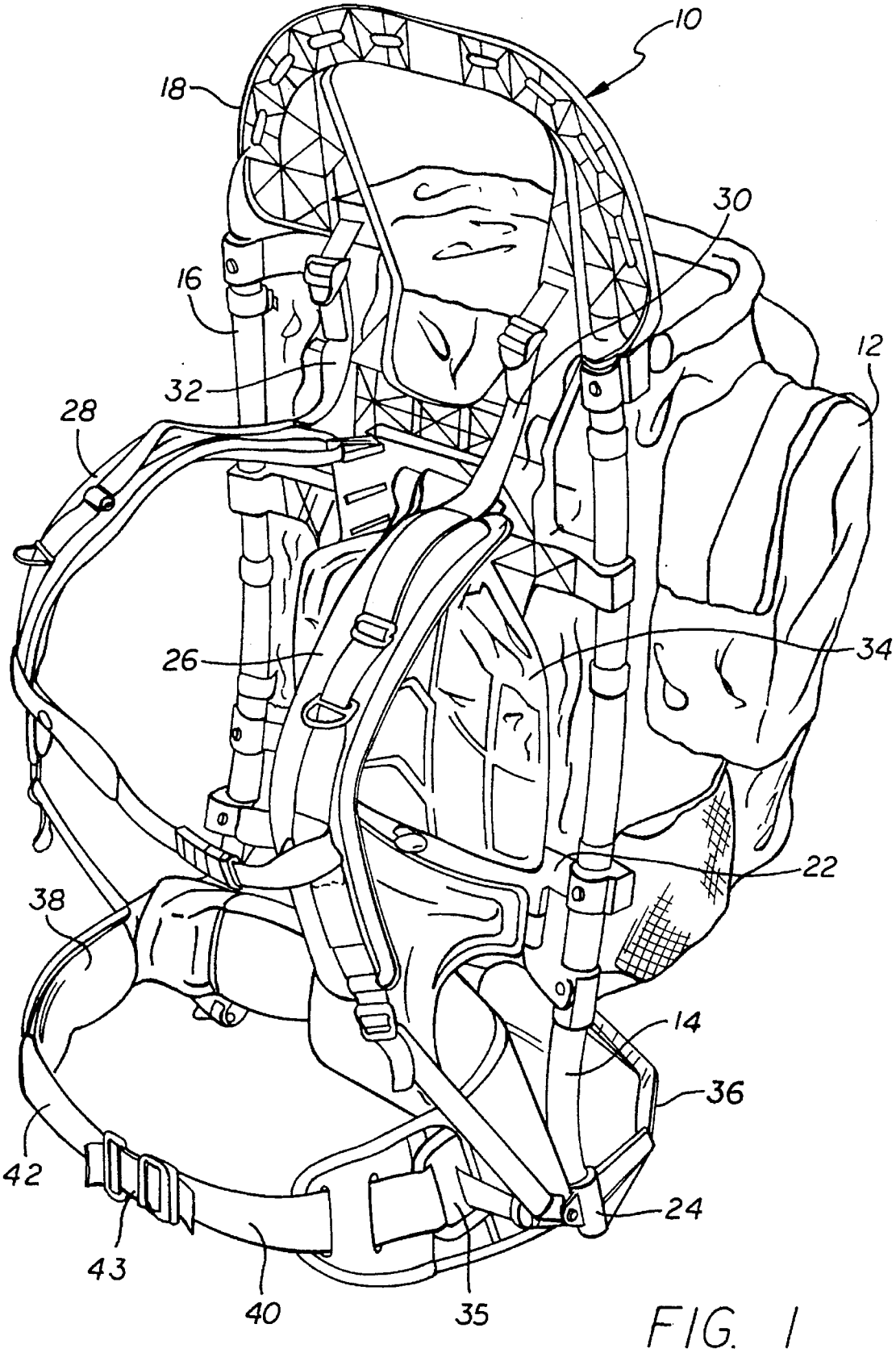
FIG. 1 is a perspective view of the backpack of the invention.

Referring now to FIG. 1, my backpack 10 includes a carry bag 12 fastened to a frame consisting of a pair of contoured aluminum side rails 14 and 16 to which are attached a plurality of separate molded plastic frame members including a upper member 18, a center member 22 and a bottom or lower member 24 which is fastened to the bottom of rails 14 and 16. The upper frame member 18 includes one pair of fasteners which attach to the tops of the aluminum side rails 14 and 16 and at the back of these fastener structures are a pair of socket members. Fastened to the front side of the upper frame member 18 are shoulder straps 26 and 28 which carry a pair of load control panels (discussed below) to which are secured stabilizing straps 30 and 32 respectively. Also fastened to the front of frame member 18 is a backpad member 34 which is secured at its lower edge to frame member 22. Also attached to frame member 22 is a waist support member 35 which carries padded waist band members 36 and 38. Also fastened to waist support member 35 are web belt members 40 and 42 which fasten together in front of the wearer by means of a buckle 43.

Figure 2:
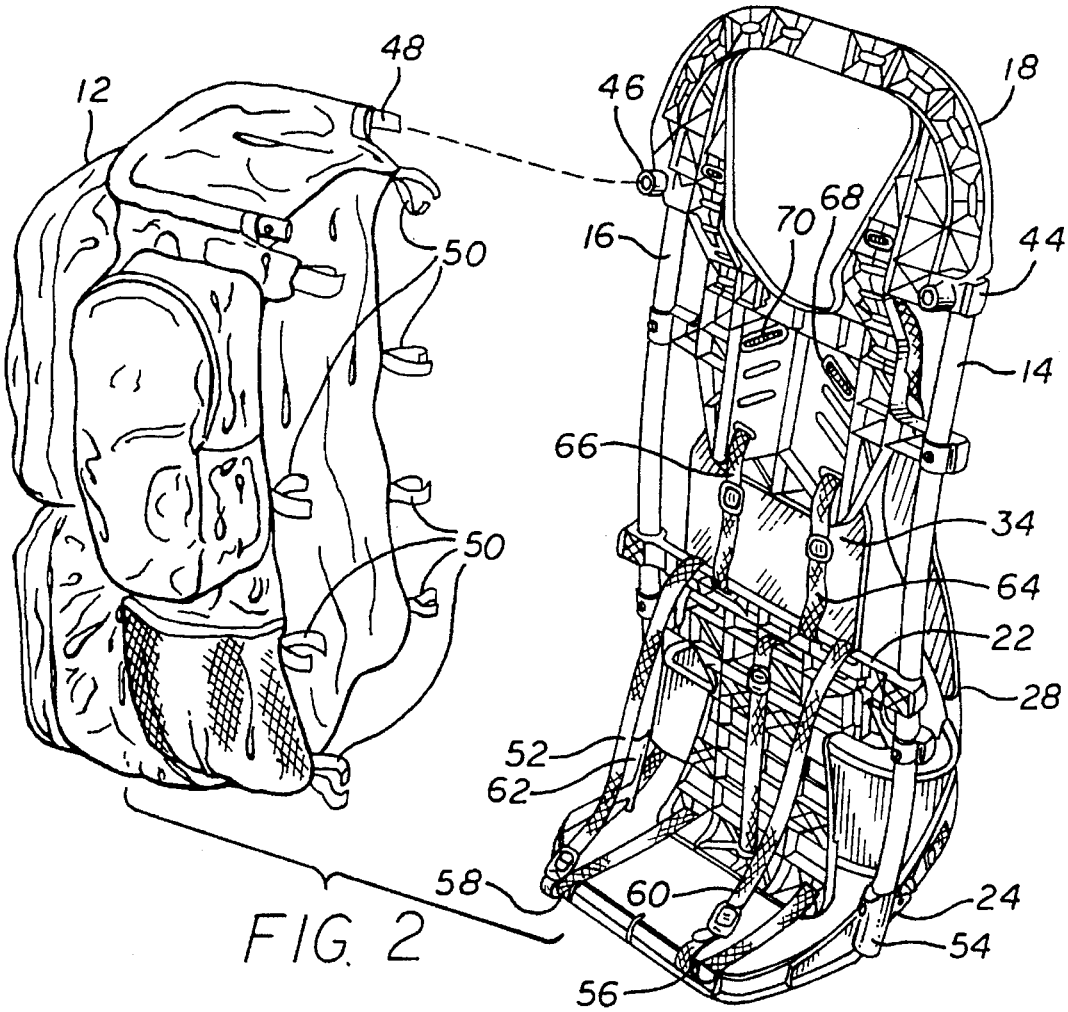
FIG. 2 is a perspective view of the backpack of the invention as viewed from the rear and with the carry bag exploded away from the frame.

FIG. 2 shows a perspective view from the rear of the backpack structure including rails 14 and 16 and the separate molded plastic frame members 18, 22 and 24, with the carry bag 12 exploded away. Upper frame member 18 includes fastening means in the form of clamp members 44 and 46 each of which have molded thereon a socket designed to receive the ends of a U-shaped support member 48 which slips into sockets 44 and 46 and which includes a spring loaded fastener for securing member 48 to sockets 44 and 46. The carry bag 12 also has a number of hook and pile fabric strips arranged along vertical side seams which strips wrap around the aluminum side rails 14 and 16 to secure the carry bag 12 to the rails 14 and 16. It also includes a number of smaller openings for receiving smaller buckles to anchor stabilizing straps 30 and 32 attached to the shoulder straps 26 and 28. U-shaped member 48 is contained in a pocket formed in the top of carry bag 12 such that it carries a substantial part of the weight of carry bag 12. Attached to vertical side seams of carry bag 12 are a plurality of open strips of hook and pile fabric 50 which are wrapped around the contoured rails 14, 16 and fastened together to secure the carry bag to the rails.

Mounted further downwardly on the side rails 14 and 16 is a center or second molded plastic frame member 22 which includes two sets of spaced fastening fixtures with a large number of truss members there-between rendering the upper part of this member quite stiff.

The lower molded plastic frame member 24 includes sockets 52, 54 into which the lower ends of rails 14 and 16 are inserted. Member 24 includes a U-shaped support member portion for supporting part of the load carried on the backpack and includes slots 56, 58 for locating a pair of straps 60, 62. This U-shaped portion is designed to extend to the rear sufficiently far to constitute a stable platform for supporting the backpack on a reasonably flat surface when the carry bag 12 is loaded.

Also shown in FIG. 2 are backpad 34 which is secured to slots near the lower end of frame member 18 and to other slots near the upper end of frame member 22 by means of a pair of straps 64, 66. Shoulder pad 28 is visible in this view and it is fastened to frame member 18 by means of a buckle 68 inserted through a slot in member 18. A similar buckle 70 fastens shoulder strap 26 to frame member 18.

Figure 3:
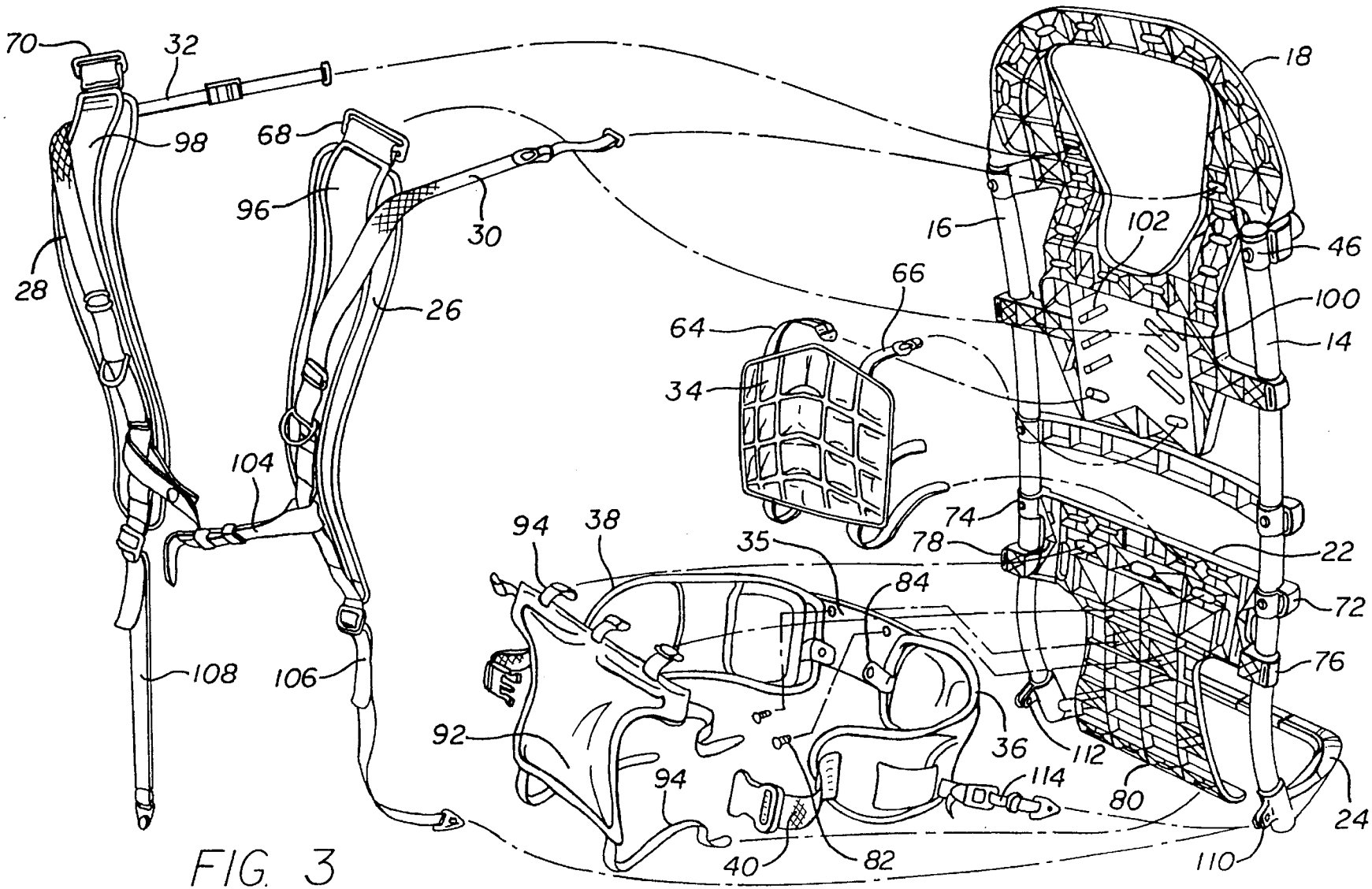
FIG. 3 is an exploded view of the backpack of FIG. 1 as viewed from the front.
Figure 4:
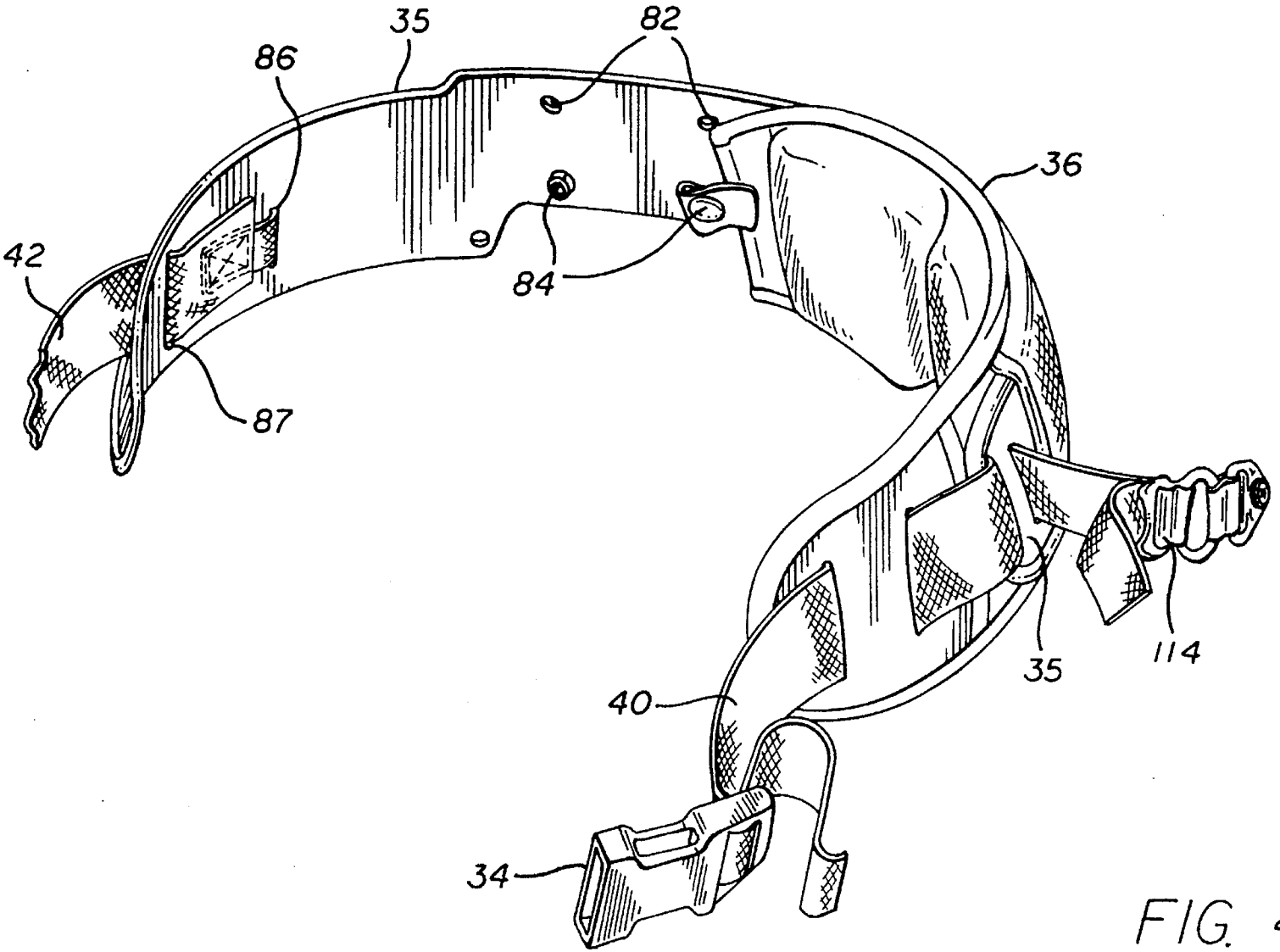
FIG. 4 is a perspective view of the waist support member incorporated in the backpack of FIG. 1.

FIG. 3 is an exploded view of the backpack according to the invention as seen from the front showing rails 14 and 16 and molded plastic frame members 18, 22, and 24. The center frame member 22 is fastened to the rails 14 and 16 by means of four fastening fixtures 72, 74, 76, and 78. The portion of frame member 22 extending between mounting structures 72, 76 and 74, 78 includes a number of deep triangular and other trusses such that the upper portion of frame member 22 is, although lightweight, very stiff and rugged. Extending downwardly and towards the rear from the upper part of frame member 22 is a thinner, more flexible "beaver tail" portion 80. This portion of frame member 22 will permit some movement both forward and backward but also in a rotating or twisting mode enabling this portion to move with the hips of the wearer. Fastened to this flexible lower portion 80 is the waist support member 35 which, as is more clearly seen in FIG. 4, is an elongated curved member of semi-rigid plastic which includes a plurality of fasteners such as screws 82 which are fastened to mating fasteners in the "beaver tail" portion 80 of member 22. Also fastened to member 35 are a pair of snap fasteners 84 which provide means for attaching the waist pad members 36 and 38. In FIG. 4, member 38 has not been shown in order to delineate the mounting means for the web belt member 42 which is secured to one arm of member 35 and is anchored through slots 86, 87. Web belt member 40 is similarly anchored to the arm on the left side of waist support member 35. With this arrangement the entire waistband structure is mounted somewhat flexibly with respect to the remainder of the backpack frame and is enabled to move with the wearer's hips.

Backpad member 34 includes straps 64 and 66 which pass through slots at the upper edge of frame member 22 and near the lower portion of frame member 18 and the straps are then buckled at the rear side of the backpack as shown in FIG. 2.

Member 92 is a lumbar pad which overlies the center portion of waist support member 35 and which includes a plurality of straps 94 having buckle fasteners for fastening itself to frame member 22. Since the lower portion of straps 94 are fastened to the flexible "beaver tail" portion 80 of frame member 22 it will be recognized that the lumbar pad 92 will also move flexibly along with the waist support member 35 with the hip action of the wearer.

Shoulder straps 26 and 28 include a polyfoam padded section on the rear side not visible on this view and on the side facing the reader includes a surface of pile material which mates with hook fastening material on a pair of load control panels 96, 98 which are removably secured to the shoulder pads 26, 28. Fastened to the load control panels 96 and 98 are stabilizing straps 30 and 32 which carry buckles for attaching them to ports near the top of frame member 18 as shown. Shoulder straps 26 and 28 also include buckles 68 and 70 which are fastened to any of several pairs of vertically arranged ports or slots 100 or 102 formed as part of frame member 18. These slots are located significantly below the point of attachment to frame member 18 of stabilizing straps 30, 32. Stitched to the load control panels 96, 98 and to the lower ends of shoulder pads 26, 28 are lower stabilizing straps 106, 108 which also fasten to the pair of forwardly extending flanges 110, 112 forming parts of the lower frame member 24.

Figure 5:
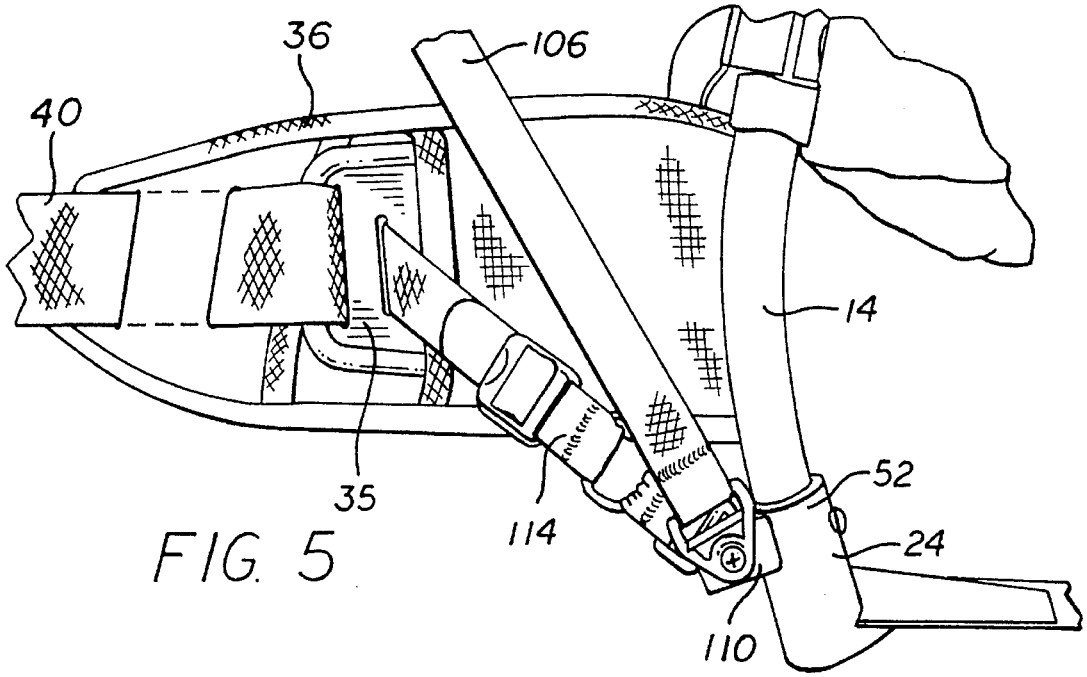
FIG. 5 is a fragmentary side view of the backpack of the invention.

Also attached to flanges 110 and 112 are some relatively short adjustable straps 114, 116 which are secured to waist support member 35. This structure is more clearly shown in FIG. 5 which shows a fragmentary portion of rail 14, the lower frame member 24 including the forwardly extending flange 110 to which is attached the lower stabilizing strap 106, and strap 114 which is attached to waist support member 35. An essentially identical structure to that shown in FIG. 5 would be visible from the opposite side of the backpack wherein all of the members 108, 116, rail 16, and socket 54 with flange 112 would be shown as a mirror image of FIG. 5.

Figure 6:
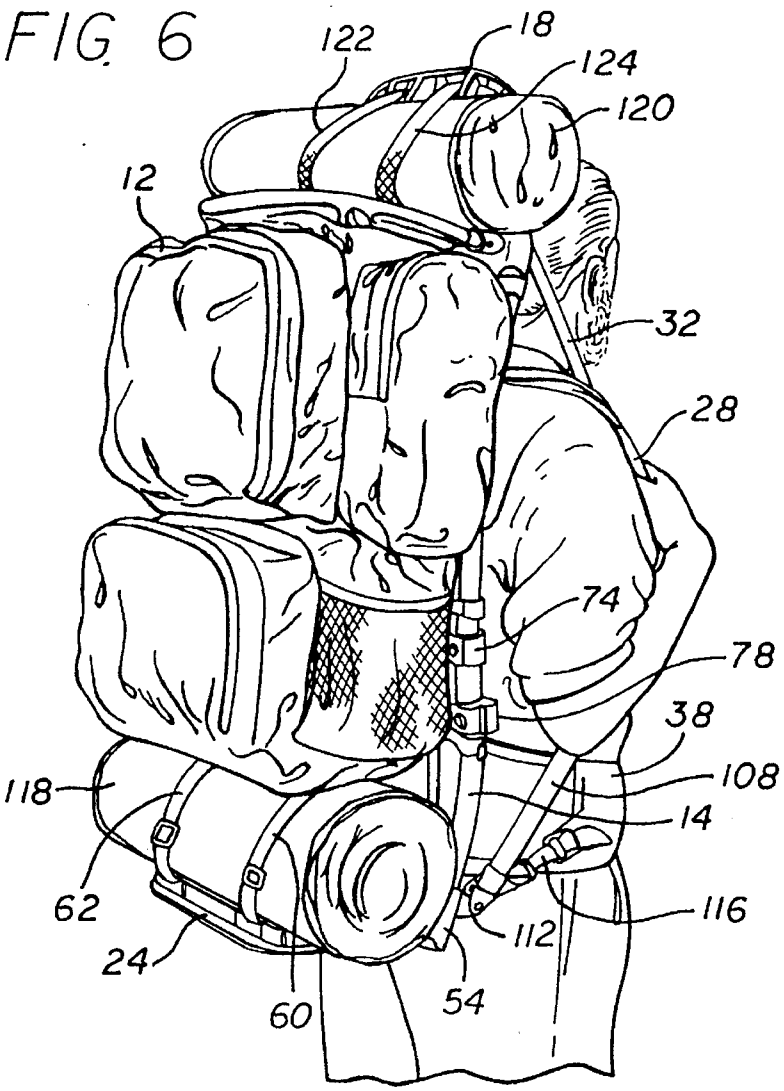
FIG. 6 is a perspective rear view of a wearer carrying the backpack of FIG. 1.

FIG. 6 is a perspective rear view of a wearer carrying the backpack of the invention. Shown in this view are side rail 14, to which is attached the lower frame member 24 by means of socket 54. Socket 54 includes the forwardly extending flanges 112 to which straps 116 and 108 are fastened. Fastened to the rear of member 24 are straps 60 and 62 which are shown employed in securing a bedroll member 118 to the backpack below the carry bag 12. Also shown in this view is the shoulder strap 28 carrying load control panel 98 to which is attached the stabilizing strap 32. Strap 32 is attached high on frame member 18, as set forth above.

Figure 7:
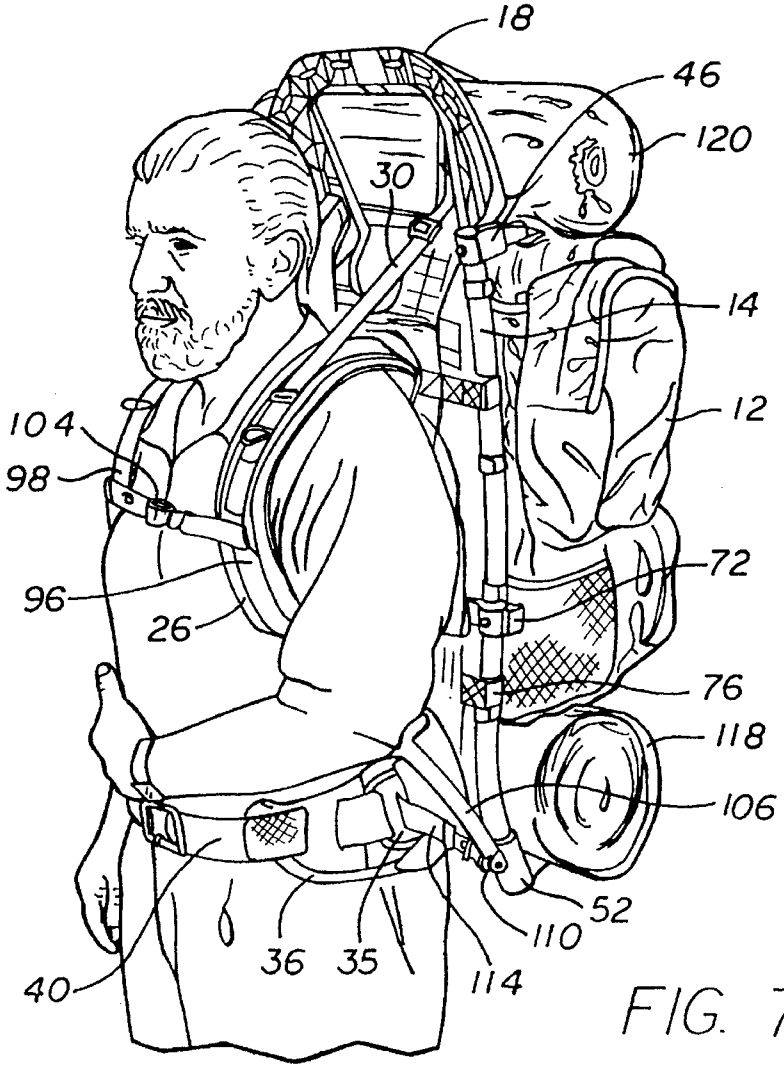
FIG. 7 is a perspective front view of a wearer carrying the backpack of FIG. 1.

FIG. 7 is a perspective view of the wearer carrying the backpack of the invention as seen from a three quarter front view. The waist support member 35 is shown to which is attached the waist pad 36, the web belt member 40 and the short strap 114 which is attached to the flanges 110 formed on socket 52 of frame member 24. Also shown are shoulder strap 26, the load control panel 96 and attached between load control panel 96 and 98 is a sternum strap 104 which prevents the shoulder straps from spreading too far outwardly. Attached to load control panel 96 is the upper stabilizing strap 30. The bed roll 118 is shown supported below carry bag 12 and above carry bag 12 is a sleeping bag 120 secured by means straps 122 and 124 (FIG. 6) fastened to the upper part of frame member 18.

From the foregoing it will be recognized that applicant has provided a backpack design having a considerable number of advantages. This pack is essentially as comfortable as the most elaborate backpacks available yet it is substantially less expensive to manufacture. It is convenient to provide this backpack in different sizes because the molded plastic frame members remain the same and it is only necessary to provide somewhat different length side rails for shorter or taller wearers and the molded frame members can be fastened to any such side rails. With the lower or bottom plastic frame member designed as shown, the backpack will stand on any reasonably flat surface with any normal loading.

The above-described embodiments of the present invention are merely descriptive of its principles and are not to be considered limiting. The scope of the present invention instead shall be determined from the scope of the following claims including their equivalents.

What is claimed is:

1. A backpack including a pair of side rails, support members fastened to said side rails, a carry bag fastened to said side rails, shoulder straps including fastening means fastened to at least one of said support members, and waistband members including fastening means for fastening said waistband members to one of said support members, said waistband members also including means for fastening said waistband members around a wearer's waist; and characterized in that said support members comprise a plurality of separate molded plastic members secured to said side rails, at least part of said plastic members including ports for receiving said fastening means;

wherein the uppermost of said separate molded plastic members includes molded thereon mounting means fastened to the top of each of said rails, said mounting means including rearwardly extending sockets, said carry bag includes a pocket and a generally U-shaped member is carried in said pocket, said U-shaped member having ends insertable in said sockets.

2. A backpack as claimed in claim 1 wherein said waistband members include a semi-rigid plastic waist support member having laterally extending arms secured to the central one of said separate molded plastic members, and padded members attached to said waist support member.

3. A backpack as claimed in claim 1 wherein the lowermost of said molded plastic members includes sockets molded therein for receiving the lower ends of said rails and forwardly extending flanges, and adjustable straps are connected from said waist support members to said flanges.

4. A backpack including a pair of side rails, support members fastened to said side rails, a carry bag fastened to said side rails, shoulder straps including fastening means fastened to at least one of said support members, and waistband members including fastening means for fastening said waistband members to one of said support members, said waistband members also including means for fastening said waistband members around a wearer's waist;

characterized in that said support members comprise a plurality of separate molded plastic members secured to said side rails, at least part of said plastic members including ports for receiving said fastening means; and wherein said shoulder straps are fastened to ports in one of said molded plastic members, another of said molded plastic members is fastened to the lower ends of said rails and includes forwardly extending flanges, and adjustable stabilizing straps are connected between said shoulder straps and said flanges.

5. A backpack as claimed in claim 4 wherein separate load control panels are removably fastened to said shoulder straps, adjustable upper stabilizing straps are fastened to said load control panels and to the one of said molded plastic members to which said shoulder straps are attached, but significantly above the points of attachment of said shoulder straps, and adjustable lower stabilizing straps are connected between said shoulder straps and said forwardly extending flanges.

6. A backpack including a pair of side rails, support members fastened to said side rails, a carry bag fastened to said side rails, shoulder straps including fastening means fastened to at least one of said support members, and waistband members including fastening means for fastening said waistband members to one of said support members, said waistband members also including means for fastening said waistband members around a wearer's waist;

characterized in that said support members comprise a plurality of separate molded plastic members secured to said side rails, at least part of said plastic members including ports for receiving said fastening means; and wherein a separate backpad is included comprising a heavy fabric panel, a plurality of polyfoam pads and a cover of stretch fabric molded together as a unit, and straps are attached at the back of said backpad for connecting said backpad between ports on two separate molded plastic members.

7. A backpack including a pair of side rails, support members fastened to said side rails, a carry bag fastened to said side rails, shoulder straps including fastening means fastened to at least one of said support members, and waistband members including fastening means for fastening said waistband members to one of said support members, said waistband members also including means for fastening said waistband members around a wearer's waist;

characterized in that said support members comprise a plurality of separate molded plastic members secured to said side rails, at least part of said plastic members including ports for receiving said fastening means; and wherein one of said molded plastic members includes a first pair of fasteners fastening said molded plastic member to said rails, a second pair of fasteners fastening said member to said rails significantly below said first pair of fasteners and a flexible downwardly and rearwardly depending panel extending below said second pair of fasteners.

8. A backpack as claimed in claim 7 wherein said waistband members include a semi-rigid plastic waist support member having laterally extending arms fastened to said flexible downwardly and rearwardly depending panel, and padded members attached to said laterally extending arms.

9. A backpack comprising a pair of side rails, a carry bag fastened to said side rails, a first molded plastic support member including a first pair of fastening means fastening said first plastic support member to the top of said side rails, a second pair of fastening means fastening said first plastic support member to said side rails below said first pair of fastening means;

a center molded plastic support member including a third pair of fastening means fastening said third molded plastic support member to said side rails and a fourth pair of fastening means fastening said third molded plastic support member to said rails below said third pair of fastening means;

a lower molded plastic support member including a fifth pair of fastening means attached to the bottom of said side rails, a rearwardly extending support rail extending from one to the other of said fifth pair of fastening means, and forwardly extending flanges on said fifth pair of fastening means; and attachment means including a plurality of straps for attaching said backpack to a wearer.

10. A backpack as claimed in claim 9 wherein said first pair of fastening means includes reawardly extending sockets, said carry bag includes a pocket, and a generally U-shaped member is carried in said pocket, said U-shaped member having ends which are insertable in said sockets.

11. A backpack as claimed in claim 9 wherein said center molded plastic member includes a flexible downwardly and rearwardly depending panel extending below said fourth pair of fastening means.

12. A backpack as claimed in claim 11 wherein said attachment means includes a semi-rigid plastic waist support member secured to said flexible downwardly and rearwardly depending panel.

13. A backpack as claimed in claim 12 wherein adjustable straps are connected between said waist support member and said forwardly extending flanges.

14. A backpack in accordance with claim 12 wherein a polyfoam lumbar pad is provided, said lumbar pad including a plurality of straps for securing said lumbar pad to said center molded plastic support member over said waist support member.

15. A backpack as claimed in claim 9 wherein said first molded plastic support member includes a plurality of ports, and said attachment means includes a pair of shoulder straps with fastening means for fastening said shoulder straps in a first pair of said ports, adjustable stabilizing straps with fastening means fastening said stabilizing straps to said shoulder straps and to a pair of said ports located above said first pair of ports, and additional straps attached to said shoulder straps and to said forwardly extending flanges.

16. A backpack in accordance with claim 9 wherein a backpad is included, said backpad including a plurality of spaced polyfoam pads and straps fastening said backpad to said first and center molded plastic support members.

17. A backpack in accordance with claim 9 wherein any of said first, center and lower molded plastic support members are removable from said side rails and attachable to other side rails.

18. A backpack including a pair of side rails, support members fastened to said side rails, a carry bag fastened to said side rails, shoulder straps including fastening means fastened to at least one of said support members, and waistband members including fastening means for fastening said waistband members to one of said support members, said waistband members also including means for fastening said waistband members around a wearer's waist;

characterized in that said support members comprise a plurality of separate molded plastic members secured to said side rails, at least part of said plastic members including ports for receiving said fastening means; and wherein one of said molded plastic members includes a flexible downwardly depending portion which is flexible in both back and forward directions and also in a twisting mode.

19. A backpack as claimed in claim 18 wherein another of said molded plastic members includes a rearwardly extending U-shaped support rail spaced from and generally surrounding said flexible downwardly depending portion.

20. A backpack as claimed in claim 18 wherein said waistband members include a semi-rigid waist support member secured to said flexible downwardly depending portion.

* * * * *